United States Patent [19]

Jones

[11] Patent Number: 4,867,028

[45] Date of Patent: Sep. 19, 1989

[54] MUSIC SYNTHESIZER ESPECIALLY PORTABLE DRUM SYNTHESIZER

[75] Inventor: Peter S. Jones, London, England

[73] Assignee: Dynacord Electronic-Und Geratebau GmbH & Co., Straubing, Fed. Rep. of Germany

[21] Appl. No.: 217,033

[22] Filed: Jul. 11, 1988

Related U.S. Application Data

[63] Continuation of Ser. No. 871,442, filed as PCT EP85/00461 on Sep. 12,1985, published as WO86/01927 on Mar. 27, 1986, abandoned.

[30] Foreign Application Priority Data

Sep. 17, 1984 [GB] United Kingdom ..... 8423.427

[51] Int. Cl.[4] ..... G10H 1/06; G10H 3/00

[52] U.S. Cl. ..... 84/735; 84/DIG. 12

[58] Field of Search ..... 84/1.03, 1.04, 1.06, 84/1.14, 1.15, DIG. 12, DIG. 24, 1.11–1.13

[56] References Cited

U.S. PATENT DOCUMENTS

| | | | |
|---|---|---|---|
| 3,659,032 | 4/1972 | May | 84/1.04 |
| 3,748,367 | 7/1973 | Lamme et al. | 84/1.04 |
| 4,078,464 | 3/1978 | Sugiyama . | |
| 4,198,891 | 4/1980 | Weber | 84/DIG. 12 |
| 4,227,049 | 10/1980 | Thomson et al. | 84/DIG. 12 |
| 4,279,188 | 7/1981 | Scott | 84/DIG. 12 |
| 4,305,319 | 12/1981 | Linn | 84/DIG. 12 |
| 4,418,598 | 12/1983 | Klynas | 84/1.04 |
| 4,479,412 | 10/1984 | Klynas | 84/DIG. 12 |

FOREIGN PATENT DOCUMENTS

| | | |
|---|---|---|
| 1463560 | 2/1977 | United Kingdom . |
| 2132402 | 7/1984 | United Kingdom . |
| 2135497 | 8/1984 | United Kingdom . |

OTHER PUBLICATIONS

International Search Report, completed Jan. 15, 1986, by Examiner G. L. M. Kruydenberg, European Patent Office.

*Primary Examiner*—Stanley J. Witkowski
*Attorney, Agent, or Firm*—Staas & Halsey

[57] ABSTRACT

A portable drum synthesizer is described having a pressure sensitive transducer adapted to be struck by the hand or fingers. The transducer output is switched to the trigger input of one or more voice generating circuits by means of finger operated switches. Certain of the finger operated switches additionally control the pitch or other parameters of the one or more voice generating circuits. The one or more voice generating circuits are optionally contained within the portable synthesizer which can take the general form of a guitar.

11 Claims, 2 Drawing Sheets

MUSIC SYNTHESIZER ESPECIALLY PORTABLE DRUM SYNTHESIZER

This is a continuation of co-pending application Ser. No. 871,442, filed as PCT EP85/00461 on Sep. 12, 1985, published as WO86/01927 on Mar. 22, 1986, now abandoned.

BACKGROUND OF THE INVENTION

This invention relates to music synthesizers and in the most important example to drum synthesizers.

Electronic drum kits are well known. They comprise a number of pressure transducers arranged as the individual drums in a drum kit which are struck by drum sticks using an essentially conventional drumming technique. The output of each transducer is used to trigger a voice generating circuit into which have been preset the audio characteristics of the particular drum or cymbal whose sound it is desired to imitate. Electronic drum kits are expensive and bulky but these are not generally perceived as problems where the intention is to replace a conventional drum kit.

SUMMARY OF THE INVENTION

It is an essential object of this invention to provide a drum or other music synthesizer which offers a novel playing technique.

It is a further object of the present invention to provide a drum synthesizer which is portable and which may be of the same general shape and dimensions as a guitar.

It is yet a further object of certain forms of this invention to provide a less expensive drum or other music synthesizer.

Accordingly, the present invention consists, in one aspect, in a music synthesizer, especially a portable drum synthesizer comprising a body, a trigger output with a plurality of channels for connection to and triggering of respective electronic voice generating circuits, common transducer means adapted to produce an electrical signal when struck by the hand or fingers and selector means serving to connect the transducer to select channels of the trigger output, the selector means comprising hand operated switch means.

Preferably the electronic voice generating circuits are contained within the body, each of them producing, when triggered, an audio output signal at an audio output port.

In another embodiment it may be advantageous that the trigger output comprises a trigger output port for transmitting trigger output signals to remote electronic voice generating circuits. In such a case the synthesizer according to this invention can be used in conjunction with existing voice generating circuits. These may offer a wider range of features than can economically be provided in a portable synthesizer.

Advantageously, at least one of the voice generating circuits is provided with a parameter changing circuit connected with said switch means such that the audio characteristics of the voice generating circuit are determined in part by the switching state of said switch means.

Preferably, the parameter changing circuit is effective to change the pitch of the audio output signal.

Advantageously, the synthesizer can, in addition to means for operating remote electronic voice generating circuits, be provided with internal electronic voice generating circuits thereby offering a choice of modes of operation.

While this invention is primarily concerned with specific music synthesizers, the same inventive concept may be useful in music synthesizers generally.

Accordingly, the present invention consists in a further aspect in a music synthesizer comprising a plurality of electronic voice generating circuits, each producing an audio output signal when triggered, manually actuable common trigger means and selector means operable to connect the trigger means with selected ones of the voice generating circuits, the selector means comprising hand operated switch means.

In order to facilitate playing and to achieve shorter sound sequences, the common transducer means may comprise a pair of pressure transducers having electrically linked outputs and positioned to be struck respectively by the thumb (or ball) and by the fingers of the hand.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
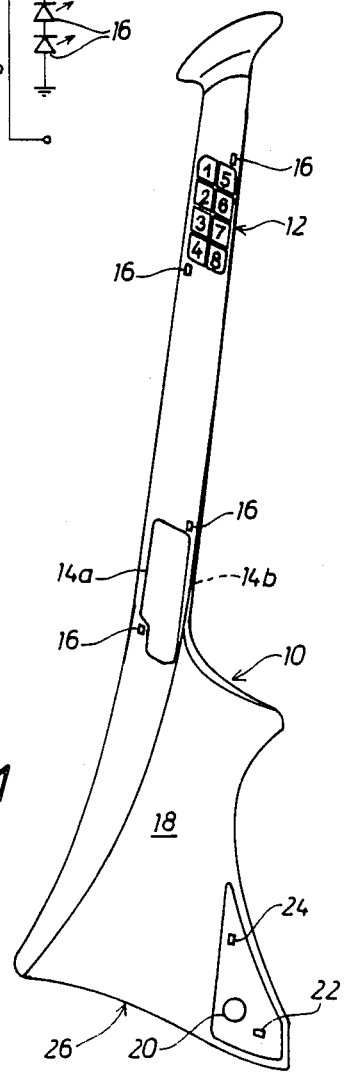
FIG. 1 is a plan view of a drum synthesizer according to the present invention.

Referring initially to FIG. 1, the drum synthesizer comprises a body 10 which is generally guitar shaped and intended to be held in the same manner as a guitar. For this purpose a strap may be provided. A bank of eight fret switches 12 is positioned so as to be operated by the fingers of one hand, whereas two pressure sensors 14*a* and 14*b* provided at the neck of the instrument can be struck by the thumb or fingers of the other hand. Only one pressure sensor is seen in FIG. 1; the other sensor is disposed at right angles to the first. The arrangement of the sensors is such that they can be struck respectively by the thumb and by the fingers with a rotational hand movement. LEDs 16 are provided each side of both the switch bank 12 and the sensors 14. These LEDs serve the dual purpose of indicating proper functioning of the instrument and also highlighting the position of the switches and sensors in dim surroundings.

Internally of the body, electronic circuitry—which will be described below—is mounted in the region 18. The body is provided on the exterior with a volume and on/off control 20, a power LED 22 and a charging LED 24. At the position 26 (not seen in FIG. 1) are output ports best described in terms of the electronic circuitry.

Figure 2:
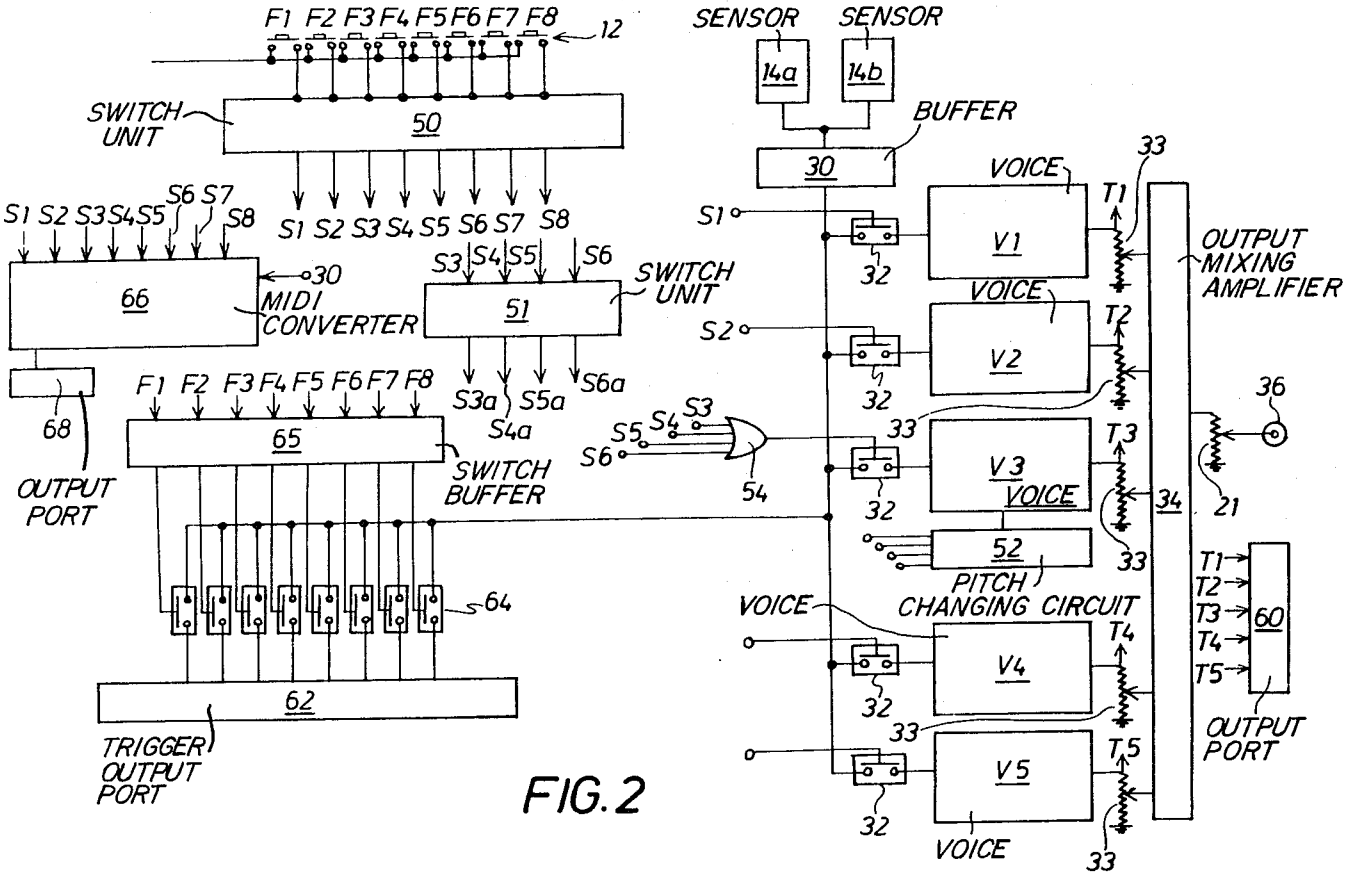
FIG. 2 is a circuit diagram mainly in block form of the synthesizer shown in FIG. 1.

Turning now to FIG. 2, the outputs of the two sensors 14(*a*) and (*b*), which may be piezo electric, are linked and connected through a buffer 30 with a parallel arrangement of five analog switches 32. The opposite side of each analog switch is connected to the trigger input of a different voice generating circuit, designated V1, V2 and so on. The output of each voice is connected through a respective level setting potentiometer 33 with an output mixing amplifier 34 connected in turn to an audio output port 36 through a potentiometer 21 operated by volume setting control 20. The output of each voice is also connected to a respective terminal T1 to T5, the function of which will be described hereinafter.

Voices V1 and V2 are generally conventional and in the preferred embodiment are of digital form based on PROM integrated circuits. The volume of the output audio signal from the voice will rise with the triggering voltage and thus with the pressure applied to the pressure sensor, but there need be no linear or other well defined relationship.

The fret switches 12 are shown diagrammatically in FIG. 2 (identified individually as F1, F2 . . . F8) and are connected electrically with a switch unit 50 which incorporates "last switch pressed" memory with polyphonic override. That is, with the fret switches being closed sequentially, a particular switch unit output is energized when the corresponding fret switch is closed and remains energized until another fret switch is closed. If two or more fret switches are closed simultaneously, or within a predetermined short time interval, all corresponding switch unit outputs will remain energized until one or more fret switches are again closed. The switch unit 50 has outputs numbered S1, S2 . . . S8 and S1 and S2 are connected directly to the analog switches 32 controlling voices V1 and V2 respectively. Thus whenever individual fret switch F1 is closed (or remains the last one of the fret switches to have been closed) or the trigger input of voice V1 remains connected to the sensors so that the operation by striking either sensor will cause voice V1 to produce its characteristic audio output at a level which is related to the force with which the sensor was struck.

Voice V2 is operated in a similar manner to Voice V1 but has different PROM characteristics. Voice V1 may serve as a bass drum; Voice V2 as a snare.

Voice 3 differs from Voices 1 and 2 in that the normal pitch of the PROM is determined not by a preset but by a pitch changing circuit 52. An additional switch unit 51 is provided at a "last switch pressed" memory for switch outputs S3 to S6 and provides auxiliary switch outputs S3*a*, S4*a*, S5*a* and S6*a*. The pitch changing circuit 52 has four presettable levels and any one of these may be selected through switch outputs S3*a*, S4*a*, S5*a* and S6*a*. The switch unit outputs S3, S4, S5 and S6 do not control separate voices but are OR'd in gate 54 to control a single analog switch 32 controlling voice V3. Thus if, say, fret switch F4 is closed, voice V3 will be connected to the pressure transducer output and will have its pitch set to the level corresponding with switch input S4*a*. The "last switch pressed memory" in switch unit 51 ensures that the pitch of voice V3 remains set even if another voice is triggered, and is of particular importance where Voice V3 has a long decay time. If two of the fret switches F3, F4, F5 and F6 are pressed simultaneously, the pitch of Voice V3 is set to a mean between the appropriate preset values. This allows still greater pitch control. If Voice V3 provides a tom audio output, switches F3, F4, F5 and F6 may be designated as high, medium high, medium low and low toms, respectively.

Voice V4 may be used to produce the sound of a hi-hat cymbal and Voice V5 a crash/ride cymbal.

The output on audio port 36 may be taken to conventional amplification equipment and loudspeakers. An alternative output port 60 is provided having five pins at which are presented the direct outputs of the voices V1, V2, V3, V4 and V5, connection being made through the described terminals T1 to T5. The port 60 may usefully be connected to an external mixer which, if available, will offer more control over the mixing of the voices and the additional treatment (through pan, echo and the like) of individual voice outputs.

In an alternative mode of operation of the described synthesizer, use is made of the voice generators in an existing drum synthesizer. That is the drum synthesizer then replaces the pressure transducers of an existing electronic drum kit. To enable the described device to be used in this mode, a trigger output port 62 is provided having eight terminals connected in parallel through respective analogue switches 64 with the pressure sensor output from buffer 30. Each analogue switch 64 is operated through a different output of switch buffer 65 which receives in turn the fret switch outputs F1 to F8. Thus, for example, if fret switches F1, F4 and F7 are closed, the sensor output will appear on trigger terminals 1, 4 and 7 only. The circuitry of the electronic drum kit will conventionally include eight different voices and voices V1, V4 and V7 will be triggered. Additionally or alternatively the synthesizer may be provided with a MIDI converter 66 (MIDI being a term of art). The MIDI converter receives as inputs the transducer output through buffer 30 and the switch outputs S1 to S8. The single output port 68 of the MIDI converter carries channels which may be associated with respective external voices. Each channel corresponds with a switch output and will carry the transducer output if, and only if, the corresponding switch output is high. The channels are encoded following industry standard MIDI formats.

Figure 3:
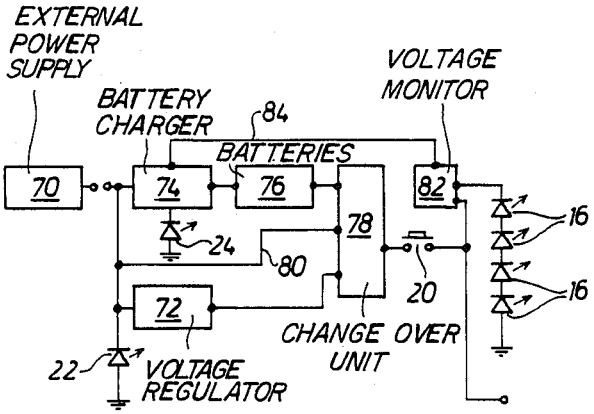
FIG. 3 is a circuit diagram of the power supply for the device.

The described synthesizer may be powered optionally from the main supply or through rechargeable batteries contained within the body. Referring to FIG. 3, an external power supply shown at 70 is connected to a voltage regulator 72 and to a battery charger 74. The charger is connected to rechargeable batteries 76 and both the batteries and the voltage regulator are connected with a change-over unit 78 supplying a power output through on/off switch 20. The changeover unit 78 takes a direct control line 80 from the power input and operates to switch from the batteries 76 to the voltage regulator 72 automatically, whenever main power is present. A voltage monitor 82 continuously monitors the power voltage and controls the illumination of LEDs 16. At normal power levels the LEDs are continuously energized but if the level drops below a preset minimum voltage, the LEDs are caused to flash. A control input is also sent on line 84 to the battery charger 74 causing the charger 74 to become effective when external power is next supplied. In this mode charging LED 24 is energized.

The batteries can of course also be recharged when the synthesizer is not in actual use. Power LED 22 is illuminated whenever main power is present, irrespective of whether the synthesizer is turned on.

The drum synthesizer described above is felt to offer a number of significant advantages. A new playing technique is introduced enabling rhythm to be created with the thumb and fingers of one hand. Changes in sound are then produced not by moving sticks from one drum to another but simply by depressing a different fret switch with the fingers of the other hand. By actuating the appropriate fret switches, a snare drum, base drum hi-hat and a selected tom may be played simultaneously with the same rhythm. If desired, an additional output terminal could be provided which is connected internally to the trigger of the bass drum voice, for example. This terminal can then be connected to a foot pedal triggering device enabling separate bass rhythms to be played or to a clock providing automatic bass rhythms.

In the mode of operation using external voices, the restriction on selecting only one tom will disappear. This would be a relatively rare occurrence, however, and the advantages of the described circuit introducing, in an ingenious fashion, eight different sounds from five voices are felt to considerably outweigh the theoretical restrictions on use. Indeed, the described manner by which one voice provides four toms may find application in drum synthesizers which are not portable and which may incorporate conventional drum stick triggering.

While this invention has been described exclusively in relation to drum synthesizers, it has more general application to music synthesizers where the voices may correspond to musical instruments other than drums or may indeed produce a sound not intended to be imitative. The present invention would continue to provide the advantages of a novel musical technique. The described methods by which a number of different sounds, each individually selectable by a switch, are produced by a smaller number of voices may also enable reductions to be made in component costs and bulk.

The invention has been described by way of example only and numerous modifications may be made without departing from the scope of the invention. While the fashioning of a drum synthesizer in the shape of a guitar is felt to be attractive, the invention is not so restricted. Alternatives could be employed to the described pressure sensors; one only may suffice and different forms of transducer are possible. It is felt desirable, particularly in a drum synthesizer, to have a pressure transducer but other forms of manually operable trigger may sometimes be appropriate. The described fret switches may be touch sensitive to take some other form, not necessarily involving eight separately actuable switch elements. The described arrangement has the attraction of resembling guitar fingering but alternatives will suggest themselves to those skilled in the art.

The feature of the power supply by which switch over between batteries and main input is achieved automatically by a relay or similar device operated through sensing of the power line will be useful in applications other than synthesizers and is regarded as separately novel and inventive.

I claim:

1. A music synthesizer, comprising:

a body adapted to be hand held;

a trigger output with a plurality of channels for connection to and trigger of respective electronic voice generating circuits;

common transducer means provided on the body and adapted to produce an electrical signal when struck by the hand or fingers; and selector means serving to connect the common transducer means to any selected channel of the trigger output for provision thereat of said electrical signal, the selector means including hand operated switch means, the switch state of which determines which of the plurality of channels is selected for connection to the common transducer means and the hand operated switch means being provided on the body so as to be actuable simultaneously with striking of said common transducer means.

2. A synthesizer according to claim 1, wherein the electronic voice generating circuits are contained within the body, each producing when triggered an audio output signal at an audio output port.

3. A synthesizer according to claim 1, wherein the trigger output comprises a trigger output port for transmitting the trigger output signals to remote electronic voice generating circuits.

4. A synthesizer according to any of the preceding claims, wherein the switch means comprises an array of finger operated switches.

5. A synthesizer according to claim 2, wherein at least one of the voice generating circuits is provided with a parameter changing circuit connected with said switch means such that the audio characteristics of the voice generating circuit are determined in part by the switching state of said switch means.

6. A synthesizer according to claim 5, wherein the parameter changing circuit is effective to change the pitch of the audio output signal.

7. A synthesizer according to claim 3, wherein the channels of the trigger output are established on respective parallel terminals.

8. A synthesizer according to claim 3, wherein the channels are encoded on common terminal means.

9. A synthesizer according to claim 3, further comprising internal electronic voice generating circuits thereby offering a choice of modes of operation.

10. A music synthesizer, comprising:

a body adapted to be hand held;

a plurality of electronic voice generating circuits disposed within said body and each producing an audio output signal when triggered;

common transducer means provided on the body and adapted to produce a trigger signal when struck by the hand or fingers; and selector means operable to connect the common transducer means to any selected one of the voice generating circuits, the selector means including hand operated switch means, the switch state of which determines which of the plurality of electronic voice generating circuits is selected for connection to the common transducer means and the hand operated switch means being provided on the body for actuation simultaneously with striking of the common transducer means.

11. A synthesizer according to claim 1 or 10, wherein the common transducer means comprises a pair of pressure transducers having electrically linked outputs and positioned to be struck respectively by the thumb and by the fingers of the hand.

* * * * *